US005457834A

United States Patent [19]

Allen, Sr.

[11] Patent Number: 5,457,834

[45] Date of Patent: Oct. 17, 1995

[54] SNAP FASTENER OPENER

[76] Inventor: Richard D. Allen, Sr., 8 Elliot Pl., Jamesburg, N.J. 08831

[21] Appl. No.: 213,246

[22] Filed: Mar. 14, 1994

[51] Int. Cl.[6] ..... B25F 1/00

[52] U.S. Cl. ..... 7/169; 7/151; 81/3.55

[58] Field of Search ..... 7/151, 169, 170; 81/3.55; 254/25, 28

[56] References Cited

U.S. PATENT DOCUMENTS

| | | | |
|---|---|---|---|
| 2,687,540 | 8/1954 | Noll | 7/169 |
| 4,631,769 | 12/1986 | White | 81/3.55 |
| 5,079,791 | 1/1992 | Grech | 7/169 |
| 5,337,632 | 8/1994 | Thomas et al. | 7/169 |

*Primary Examiner*—Bruce M. Kisliuk
*Assistant Examiner*—Joni B. Danganan
*Attorney, Agent, or Firm*—Max Goldman

[57] ABSTRACT

A curved snap fastener opener has a wedged shape with a recess at one end. As the wedge end of the opener is slid between the snap fastener base and the snap fastener cap, the curved shape of the opener provides an upward pressure on the cap of the snap fastener which assists in separating the cap from the base of the snap fastener. The surfaces of the opener have no sharp discontinuities which can result in breakage if additional pressure is applied at the end of the opener opposite the wedge end to pry open unyielding snap fasteners. The opener is small and has an opening which allows it to be carried on key holders such as key chains and key rings.

10 Claims, 1 Drawing Sheet

SNAP FASTENER OPENER

BACKGROUND OF THE INVENTION

This invention relates generally to tools and devices for opening fasteners and more particularly to devices for opening snap fasteners. Snap fasteners comprise a base which is fixed to a material or surface by a rivet, screw or other holding device, and a second mating element or cap which can be removably snapped onto the base. The cap has an expandable slip ring which holds the cap fast to the base.

Snap fasteners are used for covering the open portions of boats, truck beds, or trailers, with a heavy duty fabric weatherproof material such as canvas or tarpaulin. Snap fasteners are also used in the manufacture of clothing with coats, britches and the like.

The coverings are usually removed by pulling on the fabric at the snap to release the cap from the base. Tugging at the material to open the snap fasteners is sometimes quite difficult and can result in the breakage of fingernails, particularly in the case of women. After repeated openings, the tugging also results in damage to the fabric or material to which the snap fastener has been applied.

U.S. Pat. No. 5,079,791 (Grech) discloses a tool for unsnapping snap fasteners and reattaching snap fasteners. The tool consists of a straight handle. At one end of the handle and extending at an angle to the handle is a wedge-shaped unsnapping end which is slid between the fastener base and cap. The wedge end has a recess, between two prongs, which has sloping sides to provide lift against the underside of the fastener cap for removing the cap. Furthermore, when the fastener caps are difficult to remove, pressure may be applied to the handle to pry the fastener upwards. The other end of the handle is used for reattaching the cap of the snap fastener to the base.

Other types of prying devices are disclosed in U.S. Pat. No. 2,811,061 (Radovich) for removing the lids of film cartridges; and in U.S. Pat. No. 4,520,696 (Wolze) for opening champagne bottles.

There is a need for a snap fastener opener which is small, light and portable and which is simple and easy to manufacture and can be easily carried on a key chain and in which the shape of the opener provides additional upward force against the cap of the fastener to assist in the opening of fasteners which are difficult to open.

OBJECTS OF THE INVENTION

Accordingly, it is the general object of the instant invention to provide a snap fastener opener which overcomes the shortcomings of, and improves upon, existing devices.

It is a further object of the instant invention to provide a snap fastener opener with a wedge-shaped end for prying the snap fastener cap away from the snap fastener base.

It is yet a further object of the instant invention to provide a snap fastener opener which has an arcuate shape to provide upward pressure against the underside of the snap fastener cap to assist in opening the fastener.

It is still yet a further object of the instant invention to provide a snap fastener opener with a smooth, curved shape, to better withstand the pressures exerted on the opener when a manual prying force is applied to the opener.

It is another object of the instant invention to provide a snap fastener opener which is portable, light and easy to carry and which can be attached to key holders.

It is still another object of the instant invention to provide a snap fastener opener which is inexpensive and easy to manufacture.

SUMMARY OF THE INVENTION

These and other objects of the instant invention are achieved by providing a snap fastener opener which is arcuate in shape and which has a wedge-shaped end with a recess between two prongs. As the wedge-shaped end is pushed beneath the fastener cap, the arcuate shape of the opener provides an upward force on the underside of the cap which assists in separating the fastener cap from the fastener base. Furthermore, the smooth, arcuate outer surface of the opener is better able to withstand the stresses created in case pressure is required to be applied to the end opposite the wedge end of the opener, than with devices that have a straight wedge portion extending at an angle to a straight handle portion.

DESCRIPTION OF THE DRAWING

Other objects and many of the intended advantages of this invention will be readily appreciated when the same becomes better understood by reference to the following detailed description, when considered in connection with the accompanying drawing wherein.

DETAILED DESCRIPTION OF THE PREFERRED EMBODIMENTS

Figure 1:
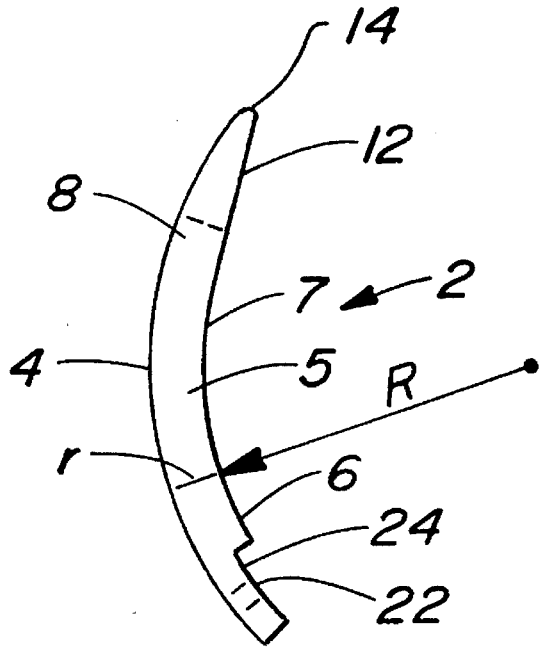
FIG. 1 is a side view of the snap fastener opener.
Figure 2:
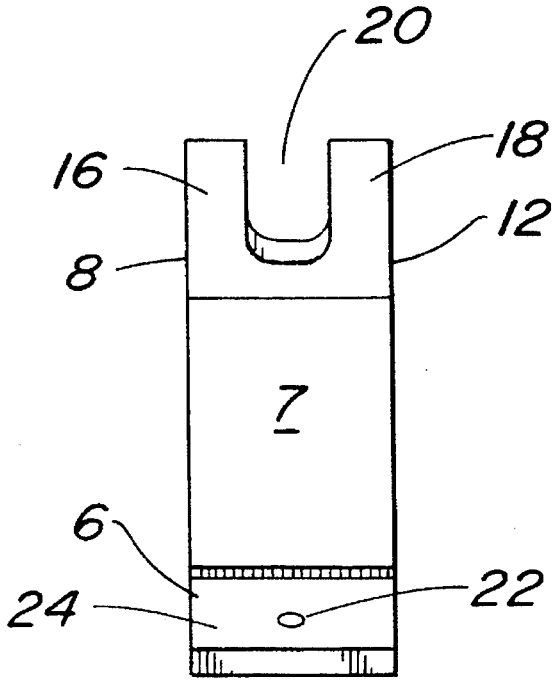
FIG. 2 is a front elevation view of the snap fastener opener.

Referring now in greater detail to the various figures of the drawing, wherein like reference characters refer to like parts, there is shown in FIGS. 1 and 2 the snap fastener opener 2 of the present invention. The snap fastener opener 2 is an arcuate member comprising a central section 5, a proximate section 6 and a distal section 8. It has an outer surface 4 and an inner surface 7 which, in the preferred embodiment, constitutes a segment of a cylindrical ring (not shown). The curved inner surface 7 has a radius of curvature R which is approximately 1 ½ inches in length. The distance r along the radial line (i.e., the thickness of the snap fastener opener 2) is approximately ¼ of an inch, resulting in a radius of curvature for the curved outer surface 4 of approximately 1 ¾ inches.

The curved inner surface 7 has an undercut portion 12 in the distal section 8. This results in the junction of the outer surface 4 and the inner surface 7 at end 14.

The undercut portion 12 provides for a wedge-shaped distal section 8. As can be seen in FIG. 2, the distal section 8 comprises a recess 20 which forms prongs 16 and 18 at the undercut portion 12. An opening 22 in the proximal section 6 of the opener 2 is provided for attachment of the opener 2 to key chains and key rings. The proximal section 6 may include an undercut portion 24 to provide greater ease in attaching the opener 2 to key holders such as key rings and the like.

To open closed snap fasteners, the opener 2 is moved forward beneath the fastener cap. The undercut portion 12 which provides a wedge shape in the distal section 8, assists in lifting the fastener cap from the fastener base as the opener is moved forward so that the recess 20 is situated below the fastener cap.

The unique shape of the opener 2 offers distinct advantages over the existing art. The opener 2 is easy and inexpensive to manufacture as it can be made of a plastic material and initially formed from cylindrical rings from which a plurality of openers can be cut. Furthermore, the curved outer surface 4 of the opener 2 provides a prying action which automatically produces an upward pressure on the base of the fastener cap as the opener 2 is slid between the fastener cap and the fastener base. In addition, in case the fastener cap resists opening, i.e., is stuck to the base, a pressure may be applied manually to the inner surface 7, at the proximal section 6, producing a fulcrum effect at the outer surface 4, which applies more prying action against the base of the fastener cap. Because there are no sharp discontinuities in the curved surfaces 4 and 7, the added pressure will not produce stresses which may result in breaking the opener as is the case with openers which comprise parts with straight surfaces which are connected together at sharp discontinuities.

The opener can be made of a suitable plastic material, a metallic material, or a composite material. In the preferred embodiment, the opener 2 is made of PVC plastic.

Exemplary dimensions for the opener 2 are 2 ½ to 3 ½ inches in length, ⅛ to ⅜ inches in thickness, with a radius of curvature to the outer surface 4 of 1 ½ to 2 ¼ inches. The recess 20 can be approximately ⅝ inches in length and ⅜ inches in width. It should be kept in mind that these dimensions are exemplary, and other suitable dimensions can be used for the opener 2.

Without further elaboration, the foregoing will so fully illustrate my invention, that others may, by applying current or future knowledge, readily adapt the same for use under the various conditions of service.

I claim:

1. A snap fastener opener comprising: an arcuate member having a central section, a proximal section and a distal section with a distal end, said arcuate member comprising a section of a cylindrical ring and having concentric curved outer and inner surfaces, said arcuate member further comprising means for unsnapping said fastener at said distal section comprising an undercut portion in said inner surface adjacent said distal section and forming a wedge at said distal end, wherein said distal section further comprises a first and a second prong separated by a recess, wherein said snap fastener opener further includes means for attaching said arcuate member to a key holder comprising an opening in said proximal section and wherein said means for attaching said arcuate member to a key holder further comprises an undercut portion in said proximal end.

2. The snap fastener opener of claim 1 wherein said arcuate member is made of plastic.

3. The snap fastener opener of claim 2 wherein said arcuate member is approximately 2 ½ to 3 ½ inches in length and ⅛ to ⅜ inch in thickness.

4. The snap fastener opener of claim 3 wherein said outer surface of said arcuate member has a radius of curvature of approximately 1 ½ to 2 inches.

5. The snap fastener opener of claim 4 wherein said recess is approximately ⅝ inches in length and ⅜ inches in width.

6. The snap fastener opener of claim 1 wherein said arcuate member is made of metal.

7. A snap fastener opener comprising: an arcuate member having a central section, a proximal section and a distal section with a distal end, said arcuate member having curved outer and inner surfaces, said arcuate member further comprising means for unsnapping said fastener at said distal section comprising an undercut portion in said inner surface adjacent said distal section and forming a wedge at said distal end, wherein said distal section further comprises a first and a second prong separated by a recess, wherein said snap fastener opener further includes means for attaching said arcuate member to a key holder, said means for attaching comprising an opening in said proximal section, and wherein said means for attaching said arcuate member to a key holder further comprises an undercut portion in said proximal end.

8. The snap fastener opener of claim 7 wherein said arcuate member is made of plastic.

9. The snap fastener opener of claim 8 wherein said arcuate member is approximately 2 ½ to 3 ½ inches in length and ⅛ inch to ⅜ inches in thickness.

10. The snap fastener opener of claim 7 wherein said arcuate member is made of metal.

* * * * *